US007509839B2

(12) United States Patent
Duranton

(10) Patent No.: US 7,509,839 B2
(45) Date of Patent: Mar. 31, 2009

(54) COSMETIC KIT INCLUDING AN INDICATOR OR SENSOR OF AMBIENT HUMIDITY

(75) Inventor: Albert Duranton, Maison Laffitte (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 11/637,106

(22) Filed: Dec. 12, 2006

(65) Prior Publication Data

US 2007/0116596 A1 May 24, 2007

Related U.S. Application Data

(62) Division of application No. 10/879,176, filed on Jun. 30, 2004, now abandoned.

(60) Provisional application No. 60/490,278, filed on Jul. 28, 2003.

(30) Foreign Application Priority Data

Jul. 4, 2003 (FR) ..... 03 08236

(51) Int. Cl.
*A45D 40/18* (2006.01)
*A45D 40/24* (2006.01)
*B65D 41/00* (2006.01)
*G01W 1/02* (2006.01)

(52) U.S. Cl. ..... 73/29.04; 73/29.01; 73/29.02; 73/335.01; 206/581; D03/273; D03/274; D03/275; D28/76; D28/78; D28/85

(58) Field of Classification Search ..... 73/29.01, 73/29.02, 29.04, 335.01; 206/216, 581, 305, 206/306, 385, 459.1, 16; D03/203.1, 202, D03/273, 274, 275; D28/76–91
See application file for complete search history.

(56) References Cited

U.S. PATENT DOCUMENTS

| | | | | |
|---|---|---|---|---|
| 2,833,149 | A | 5/1958 | Aldridge et al. | |
| 4,500,940 | A | 2/1985 | Kuisma et al. | |
| 4,818,491 | A * | 4/1989 | Fariss | 422/56 |
| 4,863,282 | A * | 9/1989 | Rickson | 374/162 |
| 4,962,910 | A * | 10/1990 | Shimizu | 250/372 |
| 5,224,373 | A * | 7/1993 | Williams et al. | 73/29.02 |
| 5,842,597 | A * | 12/1998 | Kraus et al. | 221/150 R |
| 5,875,892 | A * | 3/1999 | Martin et al. | 206/459.1 |
| 5,938,593 | A | 8/1999 | Ouellette | |
| 6,094,917 | A | 8/2000 | Sundhar et al. | |
| 6,103,351 | A * | 8/2000 | Ram et al. | 428/195.1 |
| 6,157,306 | A * | 12/2000 | Mularoni | 340/602 |
| 6,405,867 | B1 * | 6/2002 | Moore | 206/459.1 |
| 6,501,390 | B1 * | 12/2002 | Chainer et al. | 340/870.16 |
| 6,533,725 | B1 * | 3/2003 | Endo et al. | 600/306 |
| 6,544,614 | B1 * | 4/2003 | Huffer et al. | 428/40.1 |

(Continued)

FOREIGN PATENT DOCUMENTS

DE 3527715 A1 2/1987

(Continued)

*Primary Examiner*—David A. Rogers
(74) *Attorney, Agent, or Firm*—Oliff & Berridge, PLC

(57) ABSTRACT

A kit includes at least one of: a substance for one of ingestion by a human body and application to one of the skin, the mucous membranes, hair, and the nails; a cosmetic applicator; and a makeup accessory. The kit also includes at least one of: an indicator of ambient humidity; and a sensor of ambient humidity.

26 Claims, 2 Drawing Sheets

U.S. PATENT DOCUMENTS

| | | | | |
|---|---|---|---|---|
| 6,603,550 | B1 | 8/2003 | Flynn et al. | |
| 6,665,577 | B2 | 12/2003 | Onyshkevych et al. | |
| 6,787,108 | B2 * | 9/2004 | Ribi | 422/58 |
| 6,913,160 | B2 * | 7/2005 | Bourreau et al. | 206/459.1 |
| 6,927,687 | B2 * | 8/2005 | Carrender | 340/539.26 |
| 6,982,640 | B2 * | 1/2006 | Lindsay et al. | 340/540 |
| 7,248,147 | B2 * | 7/2007 | Debord et al. | 340/309.16 |
| 2001/0015089 | A1 * | 8/2001 | Kleinhans et al. | 73/23.2 |
| 2002/0028704 | A1 * | 3/2002 | Bloomfield et al. | 463/1 |
| 2003/0064350 | A1 | 4/2003 | Rubinstenn et al. | |
| 2003/0120534 | A1 | 6/2003 | Giacchetti et al. | |
| 2004/0109789 | A1 * | 6/2004 | Faran et al. | 422/58 |
| 2004/0145472 | A1 * | 7/2004 | Schmidtberg et al. | 340/539.27 |
| 2004/0154947 | A1 * | 8/2004 | Duranton | 206/459.1 |
| 2005/0067580 | A1 * | 3/2005 | Fontaine | 250/372 |
| 2005/0070778 | A1 * | 3/2005 | Lackey et al. | 600/366 |
| 2006/0013728 | A1 | 1/2006 | Moir | |
| 2006/0248946 | A1 * | 11/2006 | Howell et al. | 73/73 |

FOREIGN PATENT DOCUMENTS

| | | | |
|---|---|---|---|
| DE | 10021313 | A1 * | 11/2001 |
| JP | U-60-168406 | | 11/1985 |
| JP | A-2000-321148 | | 11/2000 |
| JP | A-2001-194332 | | 7/2001 |
| JP | A-2002-041959 | | 2/2002 |
| JP | A-2002-224049 | | 8/2002 |
| JP | A-2002-267364 | | 9/2002 |

* cited by examiner

COSMETIC KIT INCLUDING AN INDICATOR OR SENSOR OF AMBIENT HUMIDITY

CROSS-REFERENCE TO RELATED APPLICATIONS

This is a Division of application Ser. No. 10/879,176 filed Jun. 30, 2004 now abandoned, which claims the benefit of French Application No. 0 308 236 filed on Jul. 4, 2003 and of U.S. Provisional Application No. 60/490,278 filed on Jul. 28, 2003, the disclosures of the prior applications are hereby incorporated by reference herein in their entirety.

FIELD OF INVENTION

The present invention relates to devices and methods used for feeding human beings or for the treatment, such as cosmetic treatment, of the human body.

BACKGROUND

U.S. patent application Publication No. 2003/0064350 teaches recommending at least one cosmetic to a person as a function of at least one item of information associated with said person and at least one item of local information, which may comprise, for example, data concerning air quality in the geographical region where the person is located.

Furthermore, numerous substances for moistening the skin are presently on sale, for example, in the form of creams for applying to the skin.

SUMMARY OF THE INVENTION

The humidity of the air in which the user of such substances is likely to be found can vary greatly over the course of a day. Imperceptible loss of water from the skin can be strongly influenced, for example, by spending time in a space that is air-conditioned or by being exposed to the wind.

The user can thus be unaware of being in an atmosphere that is likely to cause the skin to dry more quickly, and the first symptoms of dry skin can arise after the user no longer has a moisturizer available for remedying the problem, or can no longer apply such a substance because of being otherwise engaged. In particular, one of the early symptoms can be a feeling of discomfort that the consumer might not associate directly with dry skin.

Consequently, there exists a need to enable a user of a cosmetic or another care product, for example, a cosmetic having moisturizing properties, to anticipate forthcoming changes in skin state, given the characteristics of ambient air.

Exemplary embodiments of the invention provide a kit comprising: at least one of: a substance for one of ingestion by a human body and application to one of the skin, the mucous membranes, hair, and the nails; a cosmetic applicator; and a makeup accessory; and at least one of: an indicator of ambient humidity; and a sensor of ambient humidity.

The term "indicator of ambient humidity" is used to designate an element capable of delivering information associated with ambient humidity by means that can be perceived directly by a user by one of sight, touch, hearing, and sense of smell, i.e., information about the humidity of the air surrounding the person concerned. For example, this information may be presented in the form of a relative humidity value that is displayed or a message that recommends taking or applying a substance. It may also comprise a warning about a risk of drying or some other risk associated with ambient humidity.

The term "ambient humidity sensor" is used to designate an element that is sensitive to relative humidity, but that does not deliver any information that is directly perceivable by an observer. For example, the sensor may deliver an encoded electrical signal that requires processing in order to be transformed into information that is directly perceivable by the user. The sensor may be constituted, for example, by a capacitive, resistive or other type sensor, for example, by any body having physical and/or physico-chemical properties that change with the water content of the gas in which it is found.

An ambient humidity indicator may or may not include a sensor. In exemplary embodiments, an ambient humidity indicator may comprise a sensor and a processor device that receives a signal from the sensor and delivers corresponding information. The sensor and the processor device may optionally form a unitary assembly, exchanging data where appropriate over a wired or wireless link.

In exemplary embodiments, the ambient humidity indicator or sensor may be arranged in such a manner that the user receives information which takes account of the length of exposure to an atmosphere having a given humidity. The processing of the signal delivered by the sensor may take the length of exposure into account.

For example, in exemplary embodiments, the indicator may be arranged to deliver information integrating the immediate humidity value over a given duration. Thus, changes in the relative humidity of air may be taken into account by the user only if such changes are maintained over a duration, for example, longer than about one hour, that is sufficient to be capable of having an effect on the user.

In embodiments that use a capacitive sensor, the information delivered to the user by the associated processor device may be associated, for example, with integrating an electrical current that is a function of the capacitance of the sensor over a duration of at least about one hour, for example, a duration of about two or about three hours. Integration durations may be established in order to take into account the type of substance that is to improve skin moisture and/or the type of skin of the user.

The substance may be a substance that has an effect on skin moisture or on lip moisture, either by being ingested or by being applied topically.

According to exemplary embodiments of the invention, the kit can enable a user, such as a consumer, to decide, as a function of ambient humidity, whether to ingest or apply a substance that is to protect against the drying effect of the environment in which the consumer is located.

In exemplary embodiments, the ambient humidity sensor or indicator may easily accompany the consumer to make it possible to know whether there is a risk of accelerated skin drying because of ambient low relative humidity. The consumer may then take preventative action, where appropriate, for example, by reapplying a moisturizer more frequently or by using a substance that is more suitable than the substance currently in use and selected from a range of substances provided in the kit.

In exemplary embodiments of the invention, the kit comprises firstly a substance and secondly an ambient humidity indicator or sensor incorporated in a container or packaging for the substance, or contained in a package of the substance. For example, the substance may be contained in a receptacle, and an ambient humidity indicator or sensor may be secured to the sensor, for example, by being fastened on the body thereof or on a closure member of the receptacle.

As mentioned above, in exemplary embodiments, the kit may include a processor device that processes a signal from the humidity sensor.

In exemplary embodiments, the processor device may be arranged to process data delivered by the sensor using one or more algorithms, depending on the known influence of humidity, for example, on skin.

In exemplary embodiments, where appropriate, the processor device may be arranged to receive information associated with a person in the environment of which ambient humidity is being measured, for example, information associated with the user relating to age, sex, skin type, past or present treatments, skin sensitivity, state of skin moisture, and the like of that person.

In exemplary embodiments of the invention, the kit further includes a sensor of at least one characteristic of the skin of the person concerned, for example, a moisture sensor or a sensor that is responsive to any biophysical or biochemical parameter that is associated with skin state.

In exemplary embodiments, where appropriate, the processor device may be arranged to receive a weather forecast, for example, in order to take into account the forecast when recommending action to be taken.

In exemplary embodiments, the processor device may also be arranged to receive information relating to the humidity of air in a building or a vehicle, such as, for example, an airplane, a train, or a car, by communicating with a computer network associated with the building or the vehicle.

In exemplary embodiments, the processor device may also be arranged to exchange information with a portable terminal, such as, for example, a mobile telephone or a personal digital assistance (PDA).

In exemplary embodiments of the invention, the processor device includes a transmitter that transmits information associated with ambient humidity to a remote receiver over a radio or infrared wireless link. The transmitter may be adapted in particular to transmit information to a portable terminal, such as, for example, a mobile telephone or a personal digital assistance (PDA).

In exemplary embodiments, the processor device may be constituted at least in part by a portable terminal, and the sensor may be arranged to exchange data with the portable terminal.

In exemplary embodiments, the indicator may be arranged to deliver a signal associated with ambient humidity by sight, touch, sound, or odor. The indicator may comprise, for example, at least one zone that changes color as a function of atmospheric humidity, for example, by virtue of a chemical reagent having a color that varies with ambient humidity.

In exemplary embodiments of the invention, the kit includes an ambient humidity indicator or sensor including at least one repositionable adhesive support. This can make it possible, for example, for the user to secure the indicator or sensor on a desired receptacle or article, and subsequently to reuse the indicator or sensor on another receptacle or accessory. Other releasable fastener means may also be used, for example, a Velcro® type, a screw-fastening type, a friction type, or a snap-fastening type.

In exemplary embodiments, the ambient humidity indicator may comprise at least two detachable portions, each arranged to indicate when ambient humidity crosses a predetermined humidity threshold. For example, each detachable portion may include a repositionable adhesive support. For example, each detachable portion may include a zone that changes color as a function of ambient relative humidity.

Exemplary embodiments of the invention also provide a method of advising and/or warning a person about action to be undertaken as a function of ambient humidity, the method comprising: selecting at least one indicator from a plurality of indicators, each arranged to indicate when ambient humidity crosses a respective humidity threshold, said selection being performed at least as a function of a characteristic of the person's skin and/or of a substance to be administered or applied; and issuing a warning and/or advising the person on at least one action to be undertaken in the event of the selected indicator indicating that a humidity threshold has been crossed.

For example, for a first person having skin that dries quickly, the selected indicator may be an indicator warning the person as soon as atmospheric humidity drops below a threshold which may be quite high. For example, such a threshold may lie in the range 50% to 30% relative humidity. The threshold may be optimized for each person using any algorithm or software that takes into account user satisfaction, for example, taking into consideration the user's opinion concerning the effectiveness of the warning given, when using a threshold value that is too low or too high, for example. For a second person having skin that dries less easily, the selected indicator may be an indicator that warns the person when atmospheric humidity drops below a threshold that can be much lower than for the first person.

Exemplary embodiments of the invention also provide a method of prescribing a treatment, for example, a cosmetic treatment, the method comprising issuing a recommendation about the treatment to be undertaken and/or the frequency of the treatment as a function of information delivered by at least one of an ambient humidity indicator and an ambient humidity sensor.

Exemplary embodiments of the invention also provide a method of warning and/or providing a person with a recommendation relating to the use of a substance, for example, a cosmetic or another care product, the method comprising: providing said person with at least one ambient humidity indicator or sensor that is arranged to accompany the person; issuing a warning and/or recommending at least one action, as a function of information delivered by the ambient humidity indicator or sensor.

For example, the recommended action may comprise ingesting or applying a substance having action in remedying and/or preventing the effects of increased evaporation from the skin, the mucous membranes, hair, or the nails.

Exemplary embodiments of the invention also provide a hygrometer including a display device, the hygrometer being arranged to display a recommendation concerning a frequency of taking or applying a substance, or for changing the nature of the substance being used, for example a cosmetic or another care product.

In exemplary embodiments, the recommendation may depend on a threshold which is selected by an algorithm that takes user satisfaction into consideration.

In exemplary embodiments, the hygrometer may include, an input member, for example, a set of keys, that enables the user to specify whether the recommendation is found to be satisfactory, or whether the relative humidity threshold at which the recommendation is formulated should be changed.

Exemplary embodiments of the invention also provide a cosmetic treatment method for a person, the method comprising the steps of: supplying information associated with ambient humidity by at least one indicator or sensor placed in a vicinity of said person; and applying a cosmetic or another care product at a frequency which is a function at least of said information.

Exemplary embodiments of the invention also provide a cosmetic treatment method for a person, the method comprising the steps of: providing information associated with ambient humidity by at least one indicator or sensor placed in a vicinity of said person; and selecting, as a function at least of said information, a substance having moisturizing capacities or properties that enable the effects of increased evaporation from the skin, the mucous membranes, hair, or the nails to be prevented or corrected. This selection may be performed, for example, from a plurality of substances having different moisturizing capacities.

BRIEF DESCRIPTION OF THE DRAWINGS

The invention will be better understood on reading the following detailed description of non-limiting embodiments thereof, and on examining the accompanying drawings, in which.

DETAILED DESCRIPTION OF EXEMPLARY EMBODIMENTS

Figure 1:
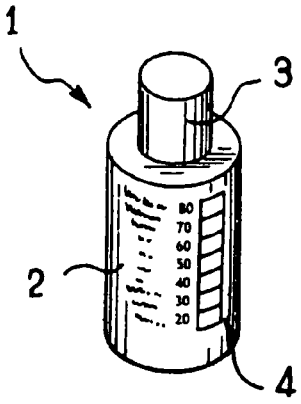
FIG. 1 is a diagrammatic perspective view of a receptacle fitted with an ambient humidity indicator according to a first exemplary embodiment of the invention, the indicator being secured to the body of the receptacle.

FIG. 1 shows an exemplary receptacle 1 comprising a body 2 and a closure member 3 releasably secured on the body 2, according to a first exemplary embodiment.

The receptacle 1 is intended to contain a substance to be ingested or a cosmetic, i.e., a substance that can be used for exerting action on one or more external conditions of the body. Cosmetics are defined in EEC Council Directive 93/35 of Jun. 14, 1993. Cosmetics include makeup and care products (for the skin, hair, and the nails), and in particular substances for hydrating the skin or the lips. The term "care products" is used to generically refer to any substance that is used to effect one or more external body conditions, such as conditions of the skin, hair and nails. For example, such substances include, but are not limited to, treatment products, such as sunscreen, moisturizer and/or medicaments, cleansing products and cosmetic products, such as makeup products, or any other known or later developed product that may be applied to the body.

The receptacle 1 may also contain a food supplement that acts on the state of the skin, the mucous membranes, hair, or the nails, and, for example, that acts to remedy and/or prevent the effects of increased evaporation from the skin, the mucous membranes, hair, or the nails. The receptacle 1 may also contain medication whose effectiveness might depend on ambient humidity and/or that acts in a particularly advantageous way in a dry atmosphere, such as, for example, anti-allergy agents, soothing agents, anti-inflammation agents, anti-psoriasis agents, and the like.

In the first exemplary embodiment, the receptacle 1 includes an ambient humidity indicator 4, for example, in the form of a colored scale having zones that change color when ambient humidity crosses a predetermined threshold. The scale may comprise, for example, a plurality of juxtaposed colored zones associated respectively with relative humidities, for example, covering a range of 20% to 80% in increments of 10%. Each colored zone changes color when ambient humidity crosses a humidity value associated with said zone. An example of such an ambient humidity indicator is sold by the supplier Sorbent System Sorbent Systems Online presence of IMPAK Corporation, 2460 East 57th Street, Los Angeles, Calif. 90058, under the reference 637 AG 10, or by the supplier Desco, 90 Hudsons Road, Canton, Mass. 02021-1404, under the reference HM-04, or by the supplier Diatero, 52 boulevard Maillot, 92200 Neuilly, France, under the reference 1288 or 1289, for example.

The exemplary receptacle 1 in FIG. 1 is illustrated in the form of a flask, but naturally could be made differently, for example, in order to apply a substance that is liquid or otherwise, for example, in powder form or in the form of a cake. The receptacle 1 may, for example, be a case including a stick of substance for applying to the lips.

The receptacle 1 may also include an applicator portion or may house an applicator, the applicator being secured to the closure member 3, for example.

The presence of the ambient humidity indicator 4 on the receptacle 1 enables a user to know whether the receptacle 1 is placed in an atmosphere that is dry or humid, and allows the user to decide as a consequence whether or not to apply the substance contained in the receptacle 1.

For example, the receptacle 1 may be sold with instructions for use recommending particular frequencies of application depending on the humidity level indicated by the indicator 4.

In the exemplary embodiment of FIG. 1, the indicator 4 is fixed on the body 2 of the receptacle 1. However, in various exemplary embodiments, the indicator 4 could be applied to the closure member 3 or could be made integrally therewith.

The indicator 4 may be arranged to indicate a relative humidity value or to specify directly an action to be undertaken as a function of ambient humidity.

For example, the closure member 3 may be made of a material whose color changes as a function of ambient humidity. When the atmosphere is dry, for example, the cap may have a certain color, thereby warning the user, for example, of a risk of dry skin.

Figure 2:
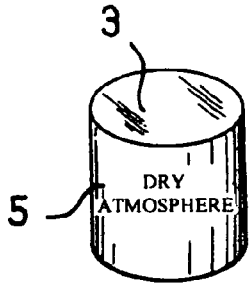
FIG. 2 is a diagrammatic perspective view of a closure member including an ambient humidity indicator according to a second exemplary embodiment of the invention.

As shown in a second exemplary embodiment in FIG. 2, the closure member 3 may also be made in part out of a material which changes color as a function of ambient humidity, for example, in order to cause a recommendation or a message 5 to appear under certain humidity conditions. This recommendation or message may disappear when ambient humidity increases.

Figure 3:
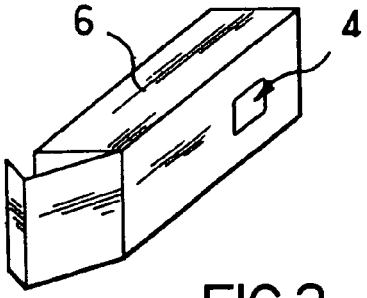
FIG. 3 is a diagrammatic perspective view of a packaging including an ambient humidity indicator according to a third exemplary embodiment of the invention.

The present invention also contemplates, in addition to providing the humidity indicator 4 on the receptacle 1 itself, providing the humidity indicator 4 on a packaging 6, for example, a cardboard box, as shown in a third exemplary embodiment in FIG. 3.

The indicator 4 may be in the form a pellet that changes color as a function of ambient humidity, for example, stuck or printed on the package 6. Including the ambient humidity indicator 4 in the package 6 may be preferred, for example, when the package 6 contains a single dose of substance to be applied or taken.

The indicator 4 may also be independent of the receptacle containing the substance and its package. For example, the indicator may be in the form of a card, such as one having a format similar to that of a credit card, or in the form of some other easily transported element, such as a ring or a clip. The format of the indicator 4 may enable the indicator 4 to be placed inside the package 6 together with the receptacle 1.

Figure 4:
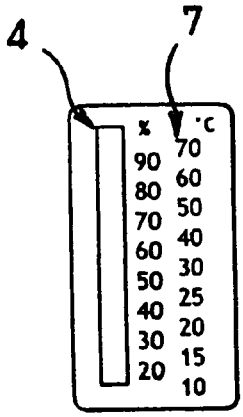
FIG. 4 is an elevation view of a fourth exemplary embodiment of an ambient humidity indicator according to the invention.

The indicator 4 may be arranged to enable the indicator 4 to be applied to clothing, for example, by a clip.

Where appropriate, as shown in the fourth exemplary embodiment of FIG. 4, the indicator 4 may be associated with a thermometer scale 7 and/or with an element that is sensitive to solar radiation, such as infrared or ultraviolet radiation.

Figure 5:
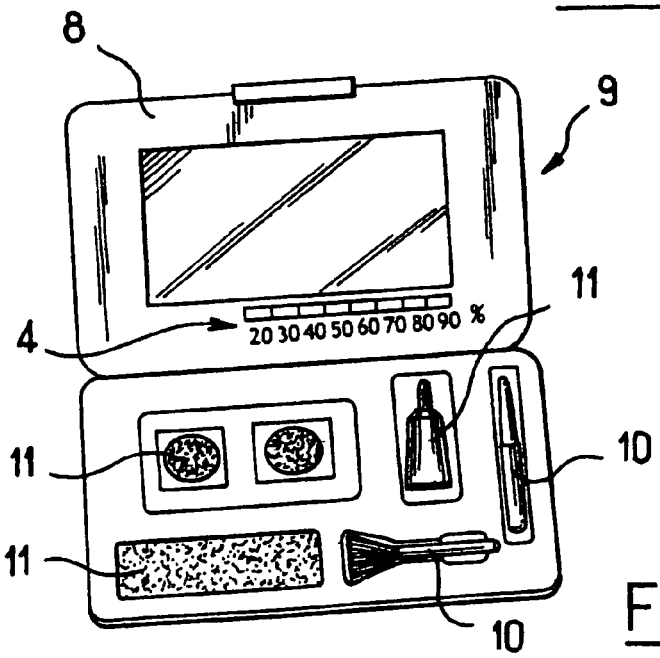
FIG. 5 is a diagrammatic perspective view of a makeup accessory including an ambient humidity indicator according to a fifth exemplary embodiment of the invention.

According to a fifth exemplary embodiment, as shown in FIG. 5, the indicator 4 may also be present on a makeup accessory, such as, for example, a lid 8 of a box 9, possibly housing one or more makeup applicators 10 together with one or more substances 11 for application.

According to exemplary embodiments, the indicator 4 may be fixed on any applicator for use in applying a substance to the human body, for example, selected from: a brush, a paintbrush, a powder puff, a pencil, a foam, a flocked endpiece. According to other exemplary embodiments, the indicator 4 may be secured to an item that is used while making up, such as a mirror, for example.

Figure 6:
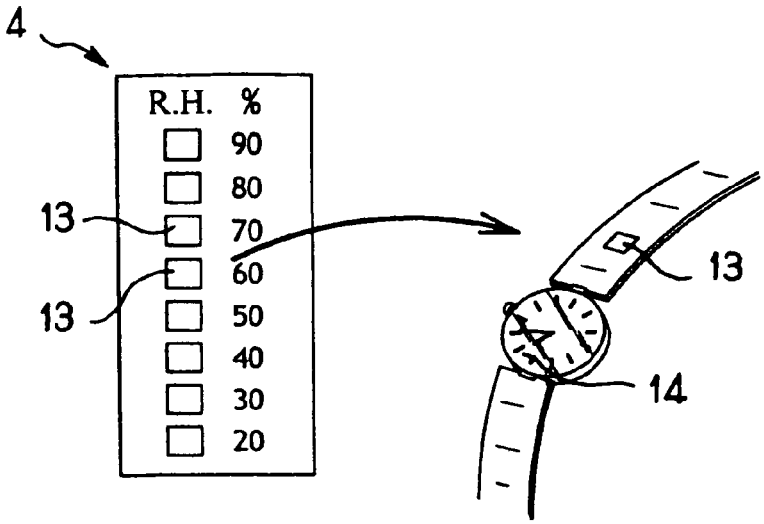
FIG. 6 illustrates an ambient humidity indicator being transferred onto an article that accompanies a moving user according to an exemplary embodiment of the invention.

As illustrated in FIG. 6, the indicator 4 may be made with at least one removable pellet 13 suitable for being peeled off and applied to an object that stays with the user when moving about, for example a watch 14.

The change in the color of the pellet 13 selected by the user provides information concerning the humidity level of the surroundings of the user and as a result can enable the user to take (ingest) or to apply a substance that is intended to avoid drying out and/or to treat the consequences thereof.

For example, the pellet 13 may be pink in color when the relative humidity is greater than or equal to 30% and may change to blue when the relative humidity drops through this threshold.

Selecting a threshold of 30% relative humidity corresponds to skin that can be said to be normal. For skin that is dry, the threshold may be higher. For a substance with high moisturizing ability, the threshold may be smaller than for a substance that is less moisturizing. For each person, the threshold may be optimized using any appropriate algorithm, for example, a chart using various sensitivity indicators for selecting thresholds for indication, possibly implemented in software form, and taking into account user satisfaction, for example, whether preventive action has been effective, or has not been effective due to using a threshold that is too low.

Figure 7:
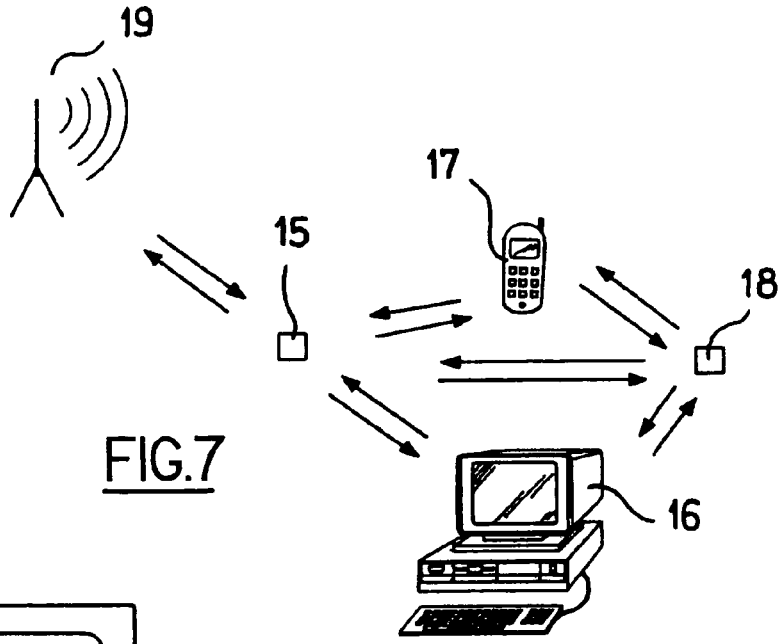
FIG. 7 is a schematic diagram of a system illustrating various data exchanges that can take place between an ambient humidity sensor and a computer and/or telephony environment according to an exemplary embodiment of the invention.

The indicator 4 may also be replaced and/or accompanied by an ambient humidity sensor 15 that is sensitive to ambient humidity, and that is capable, for example, of transmitting information to a processor device, as shown in the exemplary system shown in FIG. 7.

For example, the processor device may comprise a computer 16 or a portable terminal 17, such as a mobile telephone or a PDA, or even a special purpose device.

The sensor 15 may replace the indicator 4 in the exemplary embodiments of FIGS. 1 to 5.

The sensor 15 may include an interface that enables the sensor 15 to exchange data and at least to transit data to the processor device, for example, over a wireless connection, which may be an infrared or a radio connection, such as, for example, a Bluetooth® type, a Wi-Fi® type or the like.

The processor device, such as the computer 16 or the portable terminal 17, such as a mobile telephone, may be programmed to display the relative humidity value detected by the sensor 15 and, where appropriate, to recommend taking (ingesting) or applying a certain substance, as a function of the value that has been detected.

The recommendation delivered by the processor device may make use of knowledge concerning personal data relating to the user. For example, the processor device, or a database interrogated by the processor device, may be informed about the nature (characteristics) of the user's skin, age, sex, eating habits, cosmetics used frequently, and the like.

The recommendation delivered by the processor device may also be based at least in part on information obtained from at least one additional sensor 18 which may be a sensor applied to the skin, the mucous membranes, hair, or the nails, for example, a skin moisture sensor. When appropriate, the sensor 18 may communicate with at least one of the computer 16 and the portable terminal 17 via a wireless link. The additional sensor 18 may also be a sensor that is responsive to temperature or to solar radiation or may be a biosensor measuring or providing an indication concerning any biophysical or biochemical parameter associated with the state of the skin or the hair or the nails.

Where appropriate, the sensors 15 and 18 may be secured to each other.

At least one of the sensor 15 and the processor device may be arranged to receive information transmitted by an external information source 19, such information containing, for example, a weather forecast. A substance may then be recommended to the user as a function not only of ambient humidity, but also as a function of expected changes in atmospheric conditions, either in the same geographical location, or as a result of travel. For example, if wet weather is expected, the recommended frequency of application of the substance may be less often or the substance used may be less rich in protective agents, than if dry and/or windy weather is expected. If the user is traveling and going to a region that is dry, the processor device may take into account the future destination in order to recommend taking (ingesting) or applying a given substance accordingly.

Figure 8:
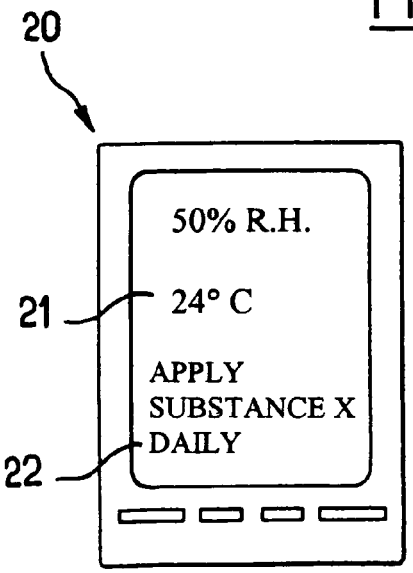
FIG. 8 is an elevation view of a hygrometer arranged to provide a recommendation associated with ambient humidity according to an exemplary embodiment of the invention.

FIG. 8 shows a hygrometer 20 made in accordance with another exemplary embodiment of the invention.

The hygrometer 20 includes a sensor that is responsive to ambient humidity, and possibly also a temperature sensor. The hygrometer 20 includes a display 21 that serves, for example, to display values for relative humidity and for temperature, as shown in FIG. 8.

The hygrometer 20 is also arranged to display a message or recommendation 22 concerning action to be taken in order to take into account the effects on the organism of the surrounding conditions as detected by the hygrometer 20, and in particular ambient humidity. This message may be selected, in particular, from the following: "Apply substance X immediately"; "Apply substance X daily"; "Apply substance X twice per day", and the like.

Naturally, the invention is not limited to the embodiments described above.

In particular, the indicator may be made in various forms other than those shown.

The various characteristics of the exemplary embodiments of the invention as described above can be combined with one another.

Throughout the description, including in the claims, the terms "including a" or "comprising a" should be understood as being synonymous with "including at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A kit comprising:

a substance for application to one of skin, mucous membranes, hair, and nails of the user, the substance including an action in at least one of remedying and preventing effects of increased evaporation from the skin, the mucous membranes, hair or the nails;

at least one of an indicator and a sensor of ambient humidity of the user in an environment in contact with the user, wherein the ambient humidity indicator or sensor is at least one of incorporated in the container for the substance, incorporated in a package for the substance and placed inside a package for the substance, wherein in response to a predetermined sensed level of ambient humidity the indicator or sensor advises, alerts and/or warns the user with regard to the taking or using of such substance.

2. A kit according to claim 1, wherein the indicator is arranged to deliver information which integrates the value of relative humidity over a given duration.

3. A kit according to claim 1, including an indicator of ambient humidity having at least one repositionable adhesive support.

4. A kit according to claim 1, including a substance having an effect on the moisture of one of the skin and the lips.

5. A kit according to claim 1, wherein the substance comprises a cosmetic configured to be applied to at least one of skin, mucous membranes, hair, and nails.

6. A kit according to claim 1, further comprising a receptacle containing the substance, and wherein one of an indicator of ambient humidity and a sensor of ambient humidity is secured to the receptacle.

7. A kit according to claim 6, wherein the indicator or the sensor is fixed on a body of the receptacle.

8. A kit according to claim 6, wherein the indicator or the sensor is fixed on a closure member of the receptacle.

9. A kit according to claim 1, wherein the indicator of ambient humidity includes at least one detachable portion, the at least one detachable portion being arranged to indicate when ambient humidity crosses a corresponding humidity threshold.

10. A kit according to claim 9, wherein the indicator of ambient humidity includes at least two detachable portions.

11. A kit according to claim 9, wherein the at least one detachable portion is arranged to indicate when a threshold of 30% relative humidity has been crossed.

12. A kit according to claim 1, comprising a humidity sensor and a device that processes a signal from the humidity sensor.

13. A kit according to claim 12, wherein the processor device is arranged to receive a weather forecast.

14. A kit according to claim 12, wherein the processor device is arranged to receive information relating to the humidity of the air in one of a building and a vehicle, by communicating with a computer network of the building or the vehicle.

15. A kit according to claim 12, including a sensor that senses at least one characteristic of the skin.

16. A kit according to claim 12, wherein the processor device is arranged to exchange information with a portable terminal.

17. A kit according to claim 16, wherein the portable terminal comprises one of a mobile telephone and a personal digital assistant.

18. A kit according to claim 12, wherein the processor device is arranged to receive information associated with a user in the environment in which ambient humidity is measured.

19. A kit according to claim 18, wherein the information associated with the user is selected from the group consisting of age, sex, skin type, previous treatment, ongoing treatment, skin sensitivity, and skin moisture state.

20. A kit according to claim 12, wherein the humidity sensor comprises a capacitive sensor.

21. A kit according to claim 20, wherein the processor device is arranged to deliver information which corresponds to integrating an electric current that is a function of the capacitance of the sensor over a duration of at least about one hour.

22. A kit according to claim 20, wherein the processor device is arranged to deliver information which corresponds to integrating an electric current that is a function of the capacitance of the sensor over a duration of about two hours.

23. A kit according to claim 20, wherein the processor device is arranged to deliver information which corresponds to integrating an electric current that is a function of the capacitance of the sensor over a duration of about three hours.

24. A package comprising:

a cosmetic applicator for applying a composition to a user; and at least one of an indicator and a sensor of the ambient humidity of the user, wherein in response to a predetermined sensed level of ambient humidity the indicator or sensor advises, alerts and/or warns the user with regard to the taking or using of such composition.

25. A package comprising:

a makeup accessory for making up a user; and at least one of an indicator; and a sensor of the ambient humidity of the user, wherein in response to a predetermined sensed level of ambient humidity the indicator or sensor advises, alerts and/or warns the user with regard to the taking or using of such makeup accessory.

26. A kit comprising:

a substance for application to one of skin, mucous membranes, hair and nails of the user, the substance including an action in at least one of remedying and preventing effects of increased evaporation from the skin, the mucous membranes, hair or the nails, at least one of an indicator and a sensor of ambient humidity that provides information associated with ambient humidity of the user, the information indicating use of the substance to at least one of remedy and prevent an effect of increased evaporation from the skin, the mucous membranes, hair or the nails, wherein in response to a predetermined sensed level of ambient humidity the indicator or sensor advises, alerts and/or warns the user with regard to the taking or using of such substance.

* * * * *